US007175485B1

(12) United States Patent
Alderson et al.

(10) Patent No.: US 7,175,485 B1
(45) Date of Patent: Feb. 13, 2007

(54) DROP IN CLAMP FOR WIRING TERMINATIONS

(75) Inventors: David Alderson, Morganton, NC (US); Michael D. Williams, Morganton, NC (US); Fred Schmidt, Morganton, NC (US); Shawn McCallister, Morganton, NC (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/293,776

(22) Filed: Dec. 2, 2005

(51) Int. Cl.
*H01R 4/30* (2006.01)

(52) U.S. Cl. ..... 439/801; 439/782

(58) Field of Classification Search ..... 439/781, 439/782, 801, 806, 809, 815
See application file for complete search history.

(56) References Cited

U.S. PATENT DOCUMENTS

| | | | | |
|---|---|---|---|---|
| 2,249,471 | A * | 7/1941 | Hamm et al. | 439/806 |
| 5,692,930 | A * | 12/1997 | Garver et al. | 439/781 |
| 6,861,189 | B1 * | 3/2005 | Greene et al. | 439/107 |
| 6,877,996 | B1 * | 4/2005 | Franks, Jr. | 439/92 |
| 6,878,876 | B2 * | 4/2005 | Brant et al. | 174/53 |

* cited by examiner

*Primary Examiner*—Thanh-Tam Le
(74) *Attorney, Agent, or Firm*—Paul J. Sutton

(57) ABSTRACT

An improved clamp that can be inserted into a wiring device independent of a wiring termination assembly thereby reducing the complexity and cost of the manufacture of the wiring device. The clamp has a pair of legs spaced apart forming an opening to allow the wiring termination assembly to be inserted therebetween. The wiring device includes support members to support the clamp legs so to permit the clamp to pivot about the support member independently of the wiring termination assembly.

4 Claims, 8 Drawing Sheets

DROP IN CLAMP FOR WIRING TERMINATIONS

BACKGROUND OF THE INVENTION

1. Field of the Invention

The present invention relates to a clamp for use in electrical wiring terminations in electrical wiring devices such as receptacles and switches.

2. Description of the Prior Art

A typical household electrical wiring circuit includes electrical loads, such as lights, electrical appliances and other loads, connected to an alternating current (AC) power source originating from the electrical service panel of the home. Connected between the loads and the power source are power cables having conductors and electrical wiring devices such as switches and receptacles for controlling the power delivered to the loads. An electrical wiring device includes wiring terminations to allow the conductors of a cable to be electrically connected to the wiring device. One type of wiring termination is a combination of a movable clamping plate and a wiring termination assembly comprising a fixed contact pad and screw which allows the bared end of a conductor to be secured between the contact pad and the clamping plate. However, this type of wiring termination may be difficult to assemble using automated assembly equipment.

What is needed is a clamp or clamping plate for use in wiring terminations to reduce the cost and complexity of the manufacture of a wiring device.

SUMMARY OF THE INVENTION

The present invention discloses an improved clamp that can be assembled into a wiring device using automated manufacturing processes. The clamp can be easily inserted into or "dropped in" an electrical wiring device in a manner that is independent of an electrical wiring termination assembly thereby facilitating the automatic assembly of the wiring device and reducing the complexity of the manufacture of the wiring device. The clamp has a pair of legs spaced apart forming a U-shaped opening to allow the screw of the wiring termination assembly to be inserted therethrough but prevent the head of the screw from passing therethrough. The wiring device includes a wiring base modified to include support members to support the clamp legs and to permit the clamp to pivot about the support members independently of the wiring termination assembly.

The foregoing has outlined, rather broadly, a preferred blending feature, for example, of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DETAILED DESCRIPTION

Figure 1:
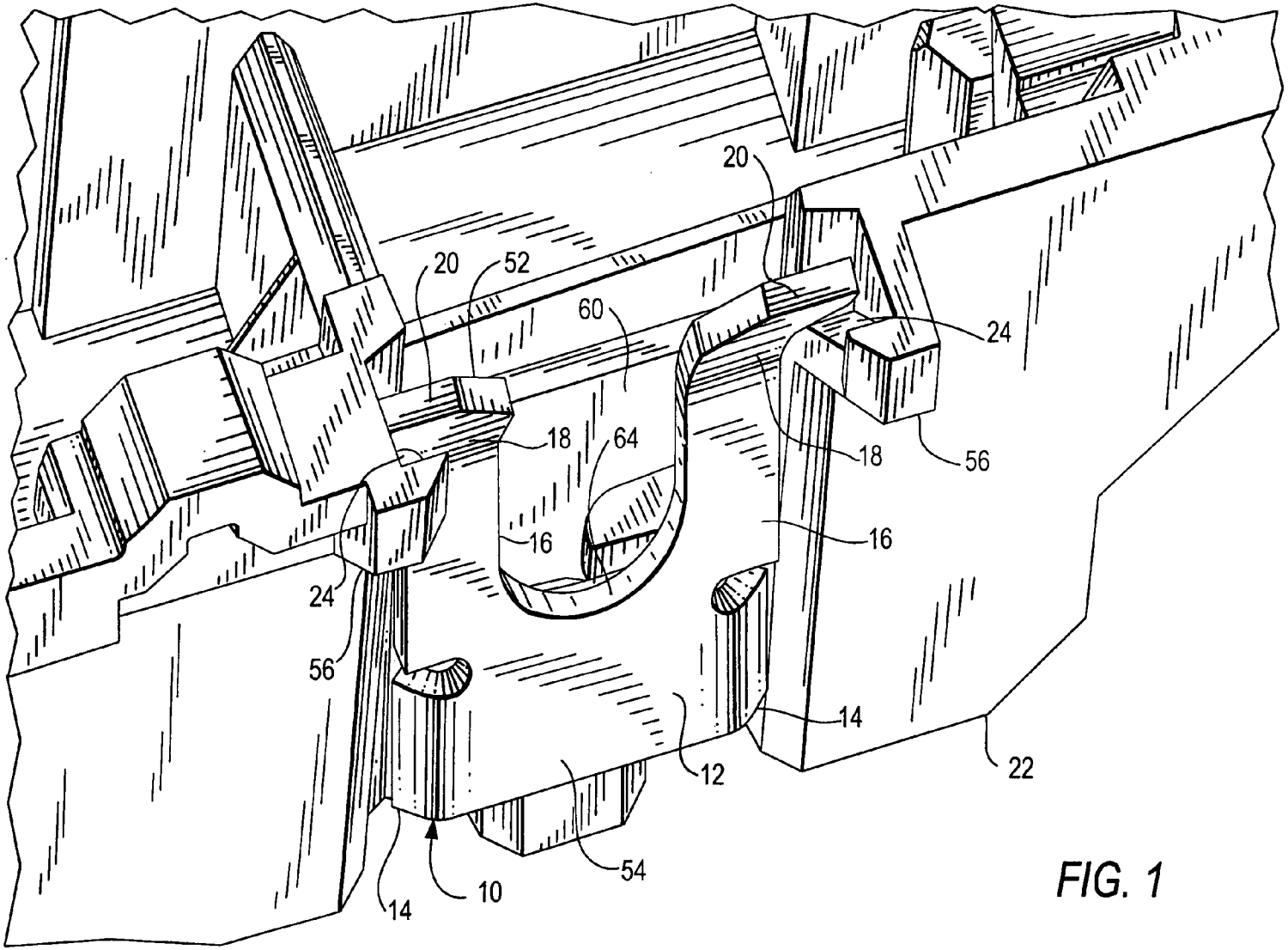
FIG. 1 is a perspective view of a clamp coupled to an electrical wiring device base according to the principles of the invention.
Figure 3:
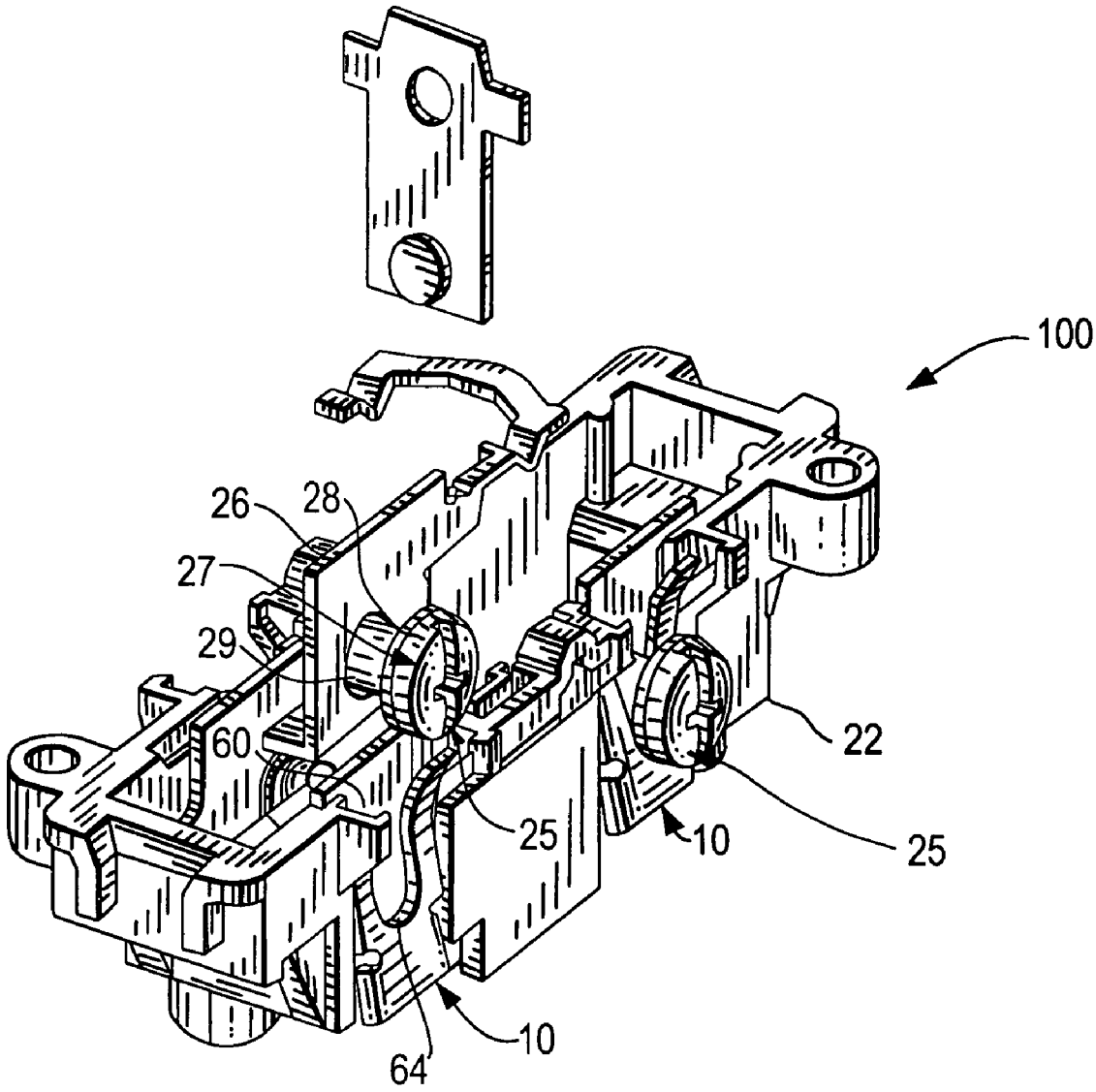
FIG. 3 is an exploded perspective view of an electrical wiring terminal assembly being inserted into the electrical wiring device base.

FIG. 1 illustrates an implementation of a clamp 10 for use with an electrical wiring that includes a wiring device base 22 which is formed by modifying a standard wiring device base to include a pair of support members 56 for supporting the clamp 10. The support members 56 are formed adjacent to a wiring termination recess 60 which holds both the clamp 10 and a wiring termination assembly 25 (FIG. 3). The clamp 10 can be easily inserted into the wiring termination recess 60 by automated assembly equipment independently of the wiring termination assembly which may help reduce the complexity and cost of the manufacture of a wiring device.

Figure 8:
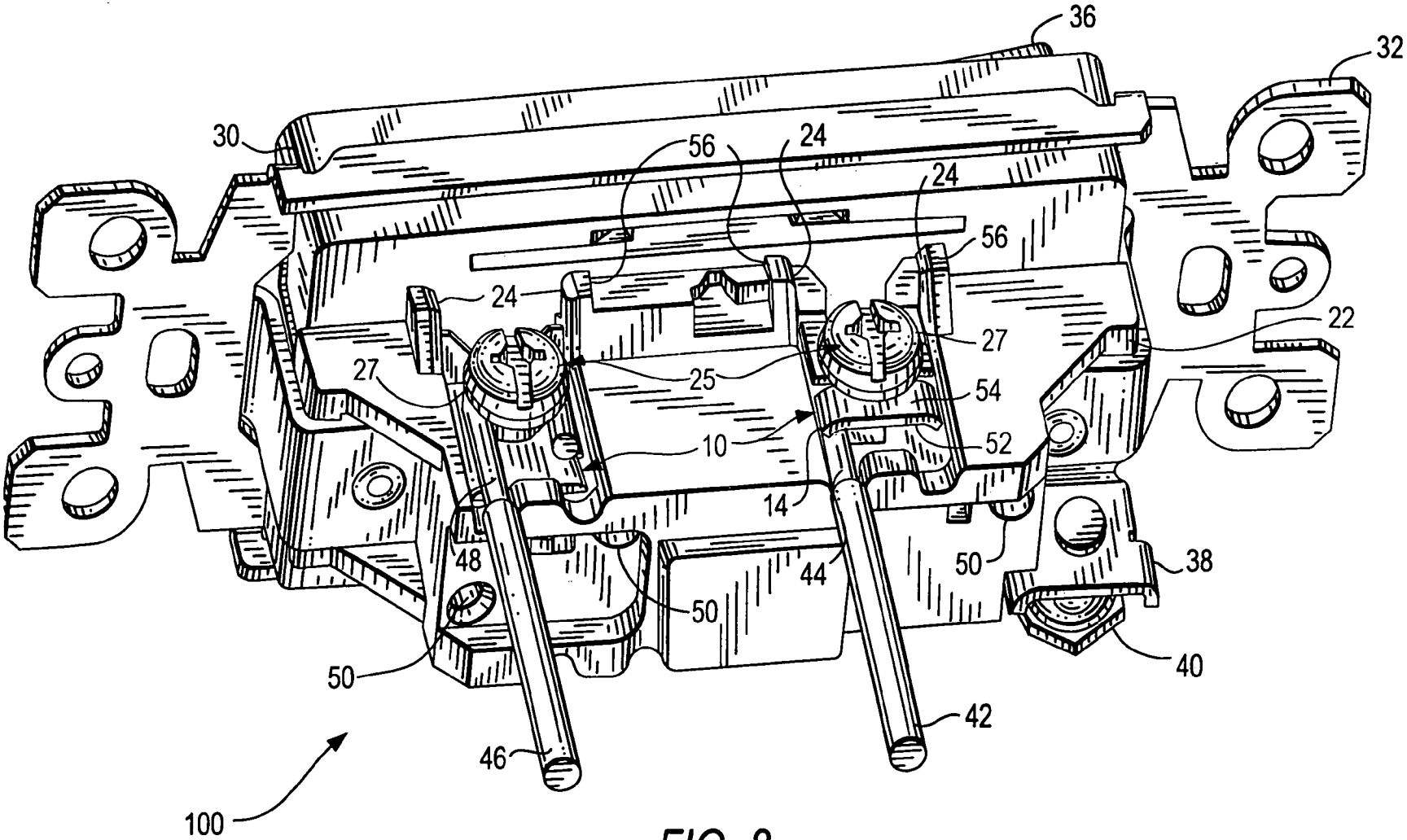
FIG. 8 is a perspective view of electrical wiring conductors being connected to the assembled electrical wiring device of FIG. 7.

The clamp 10 includes a conductive plate 12 of brass, bronze etc. with a pair of legs 16 extending from a top edge of the plate 12. The free end of the legs 16 has a bend portion 18 to allow the legs to pivot about the wiring termination recess 60. Adjacent the bend portion 18 are tabs 20 extending away from the legs 16 to permit the legs be seated in recess 24 of the support members 56 and pivot about the recess. The legs 16 are spaced apart to form a generally U-shaped opening 64 to allow clamp 10 to be inserted into the device base 22 independent of the insertion of the wiring termination assembly 25 (FIG. 3). A wiring device cover 30 (FIG. 4) is mounted over the base 22 to permit the clamp 10 to pivot freely about the recess 24 but prevent it from escaping from the recess 24. The plate 12 has an exterior surface 54 which faces away from the wiring termination recess 60 and an interior surface 52 that faces towards the recess. The clamp 10 includes tabs 14 extending downwardly from a side edge of the plate 12 and towards the interior surface 52 of the plate. The tabs 14 are shaped to make electrical contact with a straight bared end of an electrical wiring conductor (FIG. 8).

Figure 2:
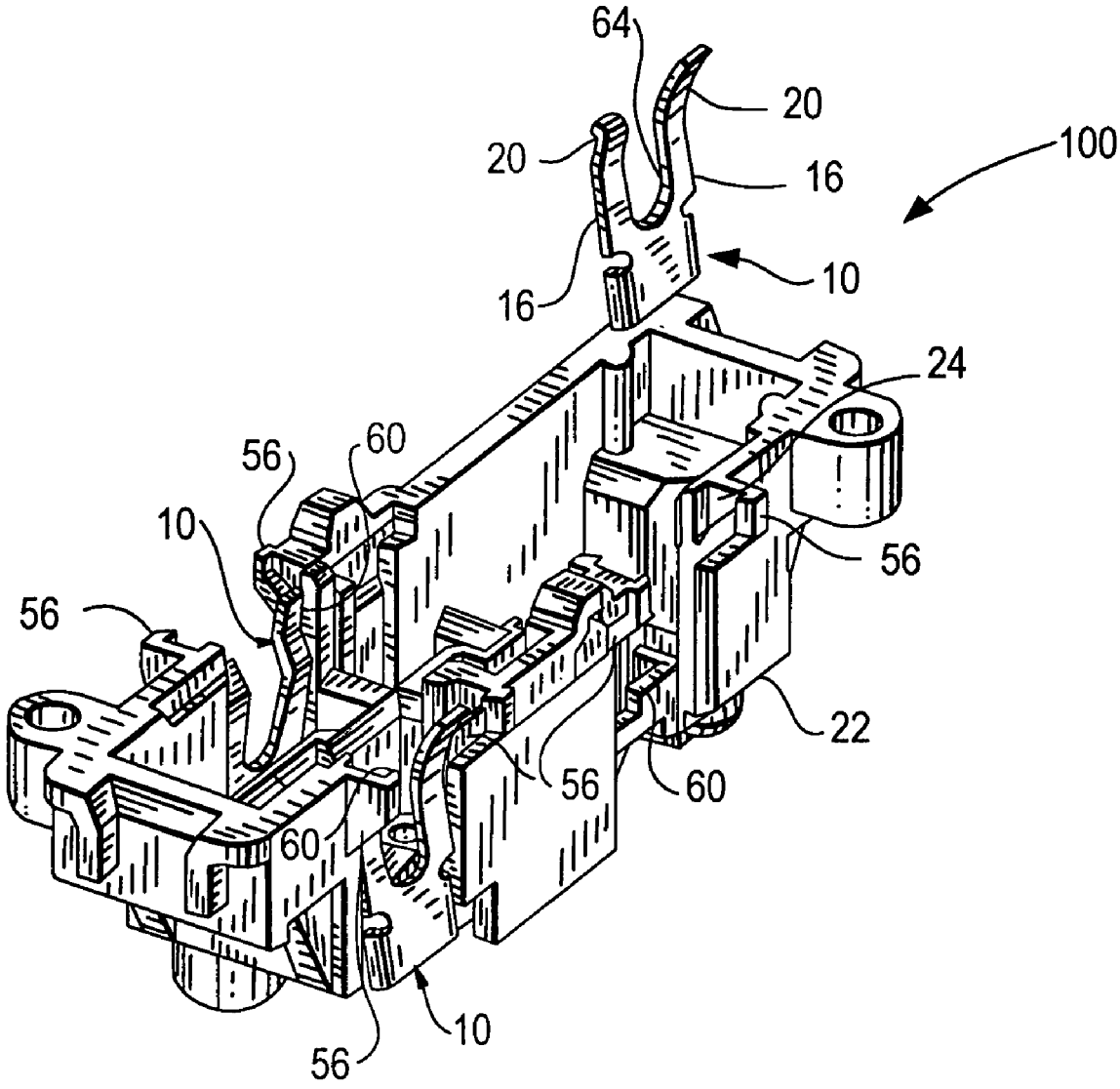
FIG. 2 is an exploded perspective view of the clamp of FIG. 1 being inserted into the electrical wiring device base.

Referring to FIGS. 2–7, the assembly of an electrical wiring switch 100 using the clamp 10 of the present invention is now described. The switch 100 can be assembled using automated assembly equipment (not shown) configured to perform an assembly process involving steps of mounting various components of the switch onto the device base 22. Referring to FIG. 2, the device base 22 is configured to support three electrical wiring conductors thereby requiring three wiring termination assemblies and three clamps 10.

In the first step of the process, the clamps 10 are inserted into the recess 60 of each wiring termination of the device base 22. The clamps 10 are inserted into the recess 60 by seating the tabs 20 of the clamps 10 onto the support recess 24 of the support members 56 which permits the tabs 20 to pivot freely about the recess. The clamps 10 are positioned into the recess 24 with the open portion of the U-shaped opening 64 facing upward to allow insertion of a wiring termination assembly 25 as shown in the next step in FIG. 3.

FIG. 3 shows the next step in the assembly process which includes the insertion of wiring termination assemblies 25 into the wiring termination recess 60 of the wiring device base 22. The wiring termination assemblies 25 each include a contact pad 26 and screw 27 where the contact pad has a threaded opening for threadably engaging the threaded shaft 29 of screw 27. During the assembly process, the wiring termination assembly 25 is advanced into the recess 60 so that pad 26 is positioned in a gap formed between the interior surface of the clamp 10 and the surface of the device base 22. The assembly 25 is further advanced toward the recess 60 so that the shaft 29 of the screw 27 is positioned in the U-shaped opening 64 of the clamp 10 and that the head 28 of the screw 27 is positioned on the exterior surface of the clamp 10. The U-shaped opening 64 is sized to allow the insertion of the shaft 29 of the screw 27 to pass therethrough but prevent the head 28 of the screw 27 from passing therethrough. Thus, the configuration of the clamp 10 allows automated equipment to insert the wiring termination assembly 25 into the wiring device independent of the insertion of the clamp.

Figure 4:
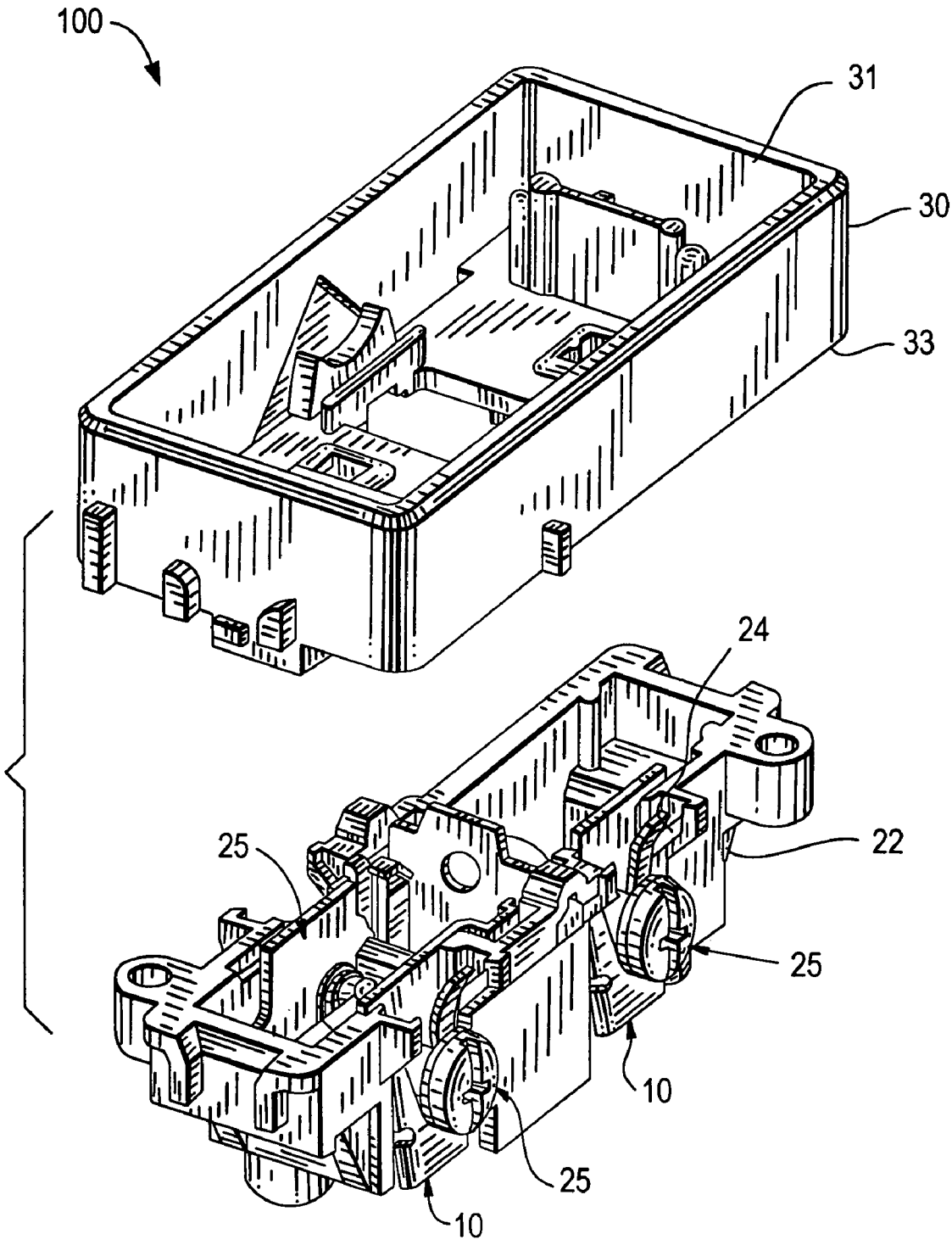
FIG. 4 is an exploded perspective view of an electrical wiring cover being mounted onto the electrical wiring device base.

FIG. 4 shows the next step in the assembly process which includes mounting the cover 30 onto the wiring device base 22. The cover 30 is mounted onto the base 22 so that a portion of the underside 33 of the cover 30 covers the recess 24 of the support member 56. In this manner, the cover permits the clamp 10 to pivot within the recess 24 but prevents it from escaping from the recess 24. The top portion 31 of the cover 30 is configured to a receive rocker switch as described below.

Figure 5:
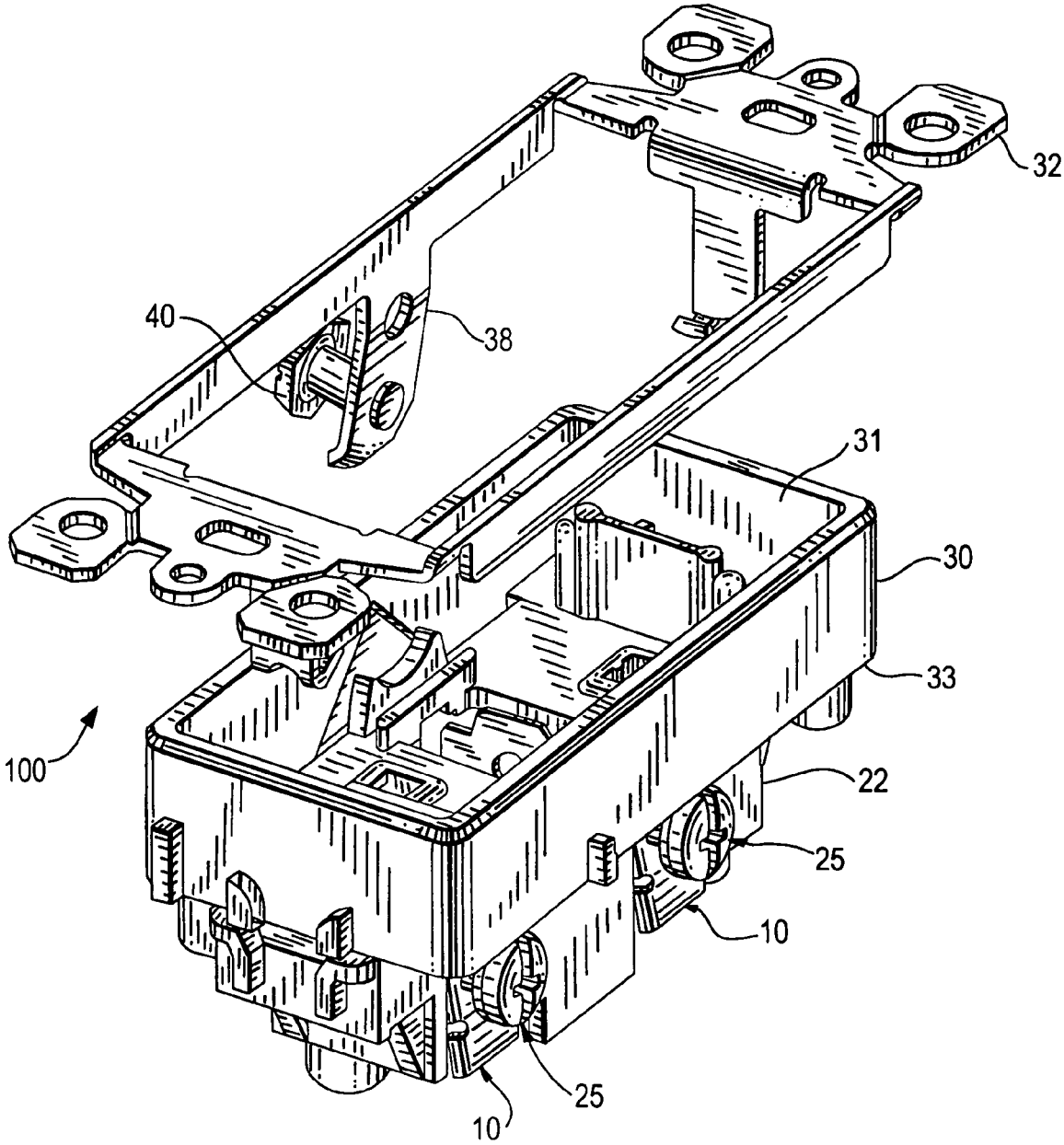
FIG. 5 is an exploded perspective view of an electrical wiring ground strap being mounted onto the electrical wiring device base.
Figure 6:
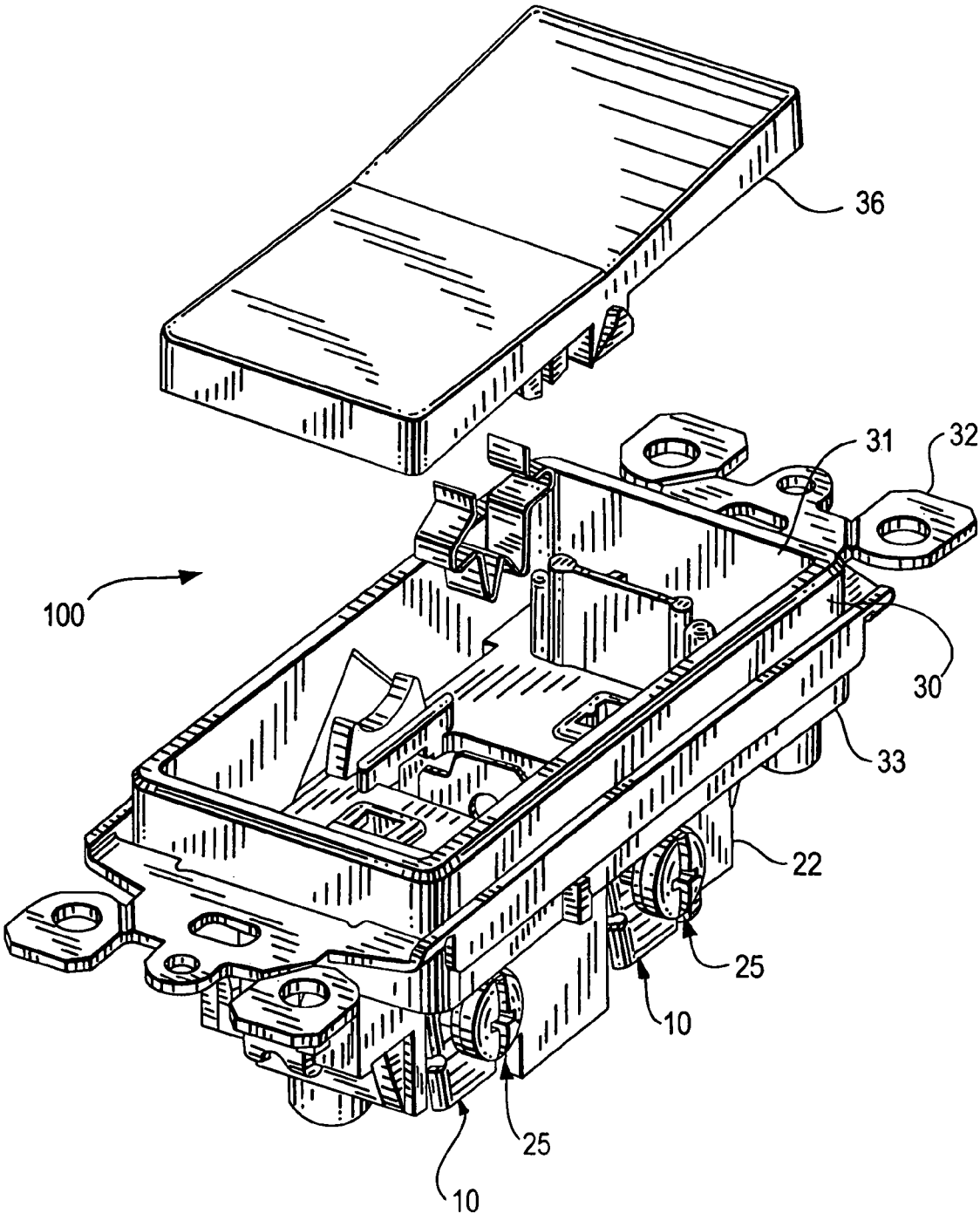
FIG. 6 is an exploded perspective view of an electrical wiring rocker switch being mounted onto the electrical wiring device.

FIG. 5 shows the next step in the assembly process which includes mounting a ground strap 32 onto the cover 30. The ground strap 32 includes a threaded lug 38 for threadably engaging the threaded shaft of ground screw 40. The strap 32 allows a ground electrical conductor (not shown) from a power cable to be connected to the strap 32 by bending the bared end of the conductor into a generally U-shaped loop and positioning the looped portion between the head of the screw 40 and the lug 38. The screw 40 is advanced in a clockwise direction which urges the screw towards the lug 38. The screw 40 is further advanced until the ground conductor is firmly secured between the screw and the lug 38. FIG. 6 shows the next step in the process which involves pivotally mounting a rocker switch paddle 36 onto the top portion 31 of the cover 30 resulting in an assembled electrical wiring switch 100 as shown in FIG. 7.

Figure 7:
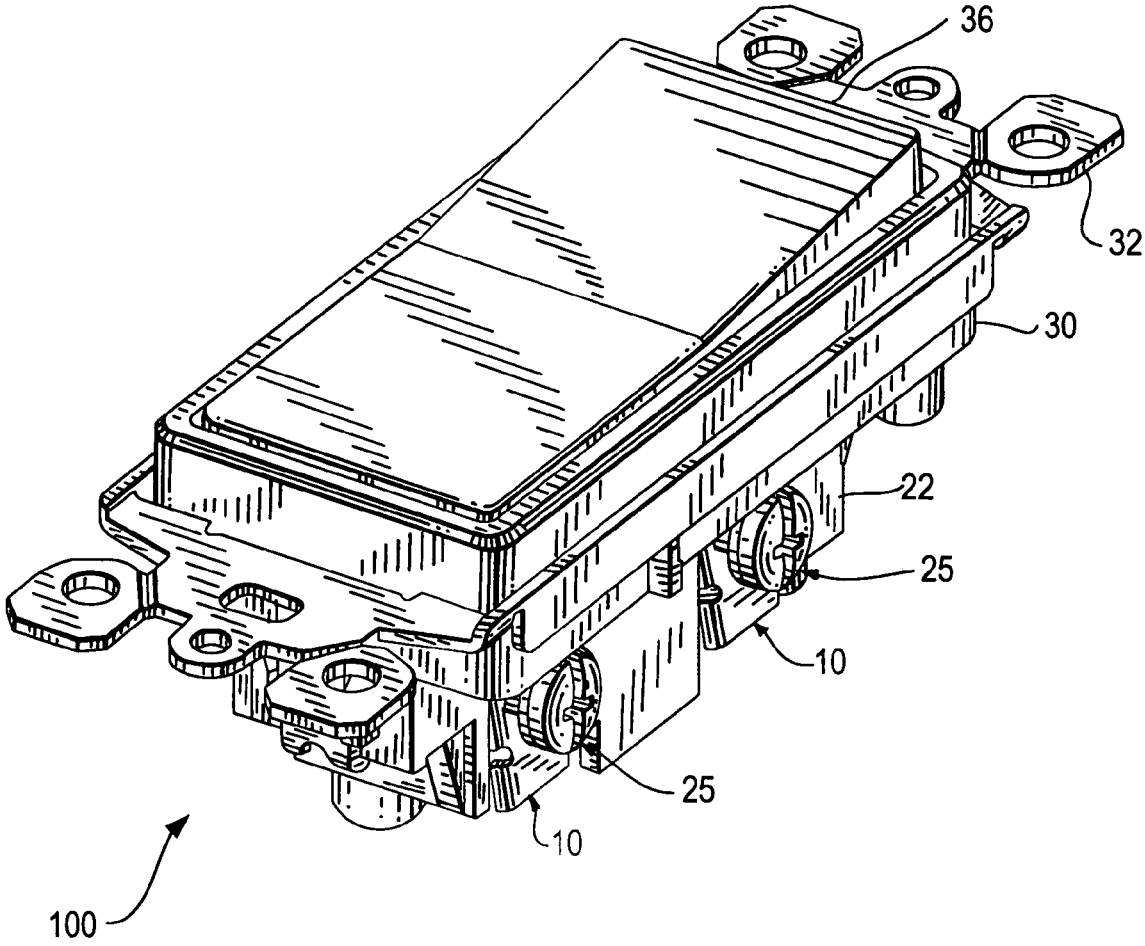
FIG. 7 is a perspective view of the assembled electrical wiring device.

FIG. 8 shows the electrical wiring switch 100 of FIG. 7 being connected to a pair of conductors 42, 46 using the clamps 10 of the present invention. A portion of the underside 33 of the cover 30 is shown covering the recess 24 of the support members 56 so that the clamp 10 can pivot about the recess but not escape from the recess. In this embodiment, the wiring device 100 is configured to allow three types of wiring terminations. In the first type of wiring termination, a straight end of the bared end 44 of the conductor 42 is inserted underneath one of the tabs 14 on the interior surface 52 of the clamp 10. As the conductor 42 is inserted, the clamp 10 is free to pivot about the support member 56 to allow the conductor to be inserted. Once the conductor is underneath the tab 14 of the clamp 10, the screw 27 of the assembly 25 is advanced until the conductor 42 make good electrical contact between the assembly and the clamp. In the second type of wiring termination, the bared end 48 of the conductor 46 is bent in a U-shaped loop and placed between the exterior surface 54 of the clamp 10 and the head of the screw 27 of the wiring termination assembly 25. Because the clamp is pivotally mounted, the clamp 10 is urged toward the contact pad of the wiring termination assembly 25. Once the conductor 46 is positioned over the clamp 10, the screw 27 of the assembly 25 is advanced until the bared end of the conductor 48 make good electrical contact between the clamp and the screw. The third type of termination is provided by push-in terminals 50 which have an opening to allow the bared end of conductor to be inserted and secured therein.

Although the clamps 10 of the present invention are shown applied to an electrical wiring switch 100, the clamps can be equally applied to an electrical wiring receptacle or other device so to benefit from the techniques of the present invention. A three terminal switch 100 is shown but the clamps 10 of the present invention can be employed with other devices having different numbers of terminals. The clamp 10 can be made of a conductive material, such as copper or brass, or a combination of conductive and non-conductive material.

While there have been shown and described and pointed out the fundamental novel features of the invention as applied to the preferred embodiments, it will be understood that various omissions and substitutions and changes of the form and details of the structures and circuits illustrated and in their operation may be made by those skilled in the art without departing from the spirit of the invention.

What is claimed is:

1. A wiring termination assembly for coupling a conductor to a wiring device wherein:

the wiring device has a base member and a cover adapted to be positioned on the base member, said base member has an aperture with recesses in side edges of said aperture;

a clamp plate having an exterior surface, an interior surface, a bottom member and a top member having and a U shaped aperture to provide a pair of spaced apart legs, ends of the pair of spaced apart legs are bent toward the exterior surface of the plate to provide a pivot surface, wherein said clamp plate is pivotally coupled to the recesses in the side edges of the aperture and is pivotally coupled to the base member, a contact pad having a threaded aperture located adjacent the interior surface of the clamp plate; and a screw having a shaft positioned in the U shaped aperture of the clamp plate and threaded into the threaded aperture of the contact pad, a head of the screw being positioned at the exterior surface of the clamp plate.

2. The wiring termination assembly of claim 1 wherein said clamp plate has tabs which extend downwardly from each side edge of the bottom member and bent toward the interior surface of the plate to help the clamp plate make electrical contact with a straight bared end of a wire conductor.

3. The wiring termination assembly of claim 2 wherein the cover is positioned onto the bottom member after the clamp plate, contact pad and screw are placed into the base member to prevent the clamp plate from escaping from the recesses and still permit the clamp plate to pivot relative to the base member.

4. The wiring termination assembly of claim 3 wherein the clamp plate and the contact pad are made of conductive material.

* * * * *